United States Patent [19]

Fujikawa et al.

[11] Patent Number: 4,478,180

[45] Date of Patent: Oct. 23, 1984

[54] CRANKCHAMBER PRECOMPRESSION TYPE TWO-CYCLE INTERNAL COMBUSTION ENGINE

[75] Inventors: Tetsuzo Fujikawa, Kobe; Toshiyuki Takada, Miki, both of Japan

[73] Assignee: Kawasaki Jukogyo Kabushiki Kaisha, Japan

[21] Appl. No.: 466,780

[22] Filed: Feb. 16, 1983

[30] Foreign Application Priority Data

Feb. 19, 1982 [JP] Japan ..... 57-26386

[51] Int. Cl.[3] ..... F02B 33/04; F02B 33/14

[52] U.S. Cl. ..... 123/59 BS; 123/73 CC; 123/73 CB; 123/59 PC; 123/74 R; 123/432; 123/433

[58] Field of Search ..... 123/73 AF, 73 CB, 73 CC, 123/73 E, 73 F, 74 AE, 73 R, 77 R, 59 BS, 59 PG, 575, 576, 577, 578, 579, 583, 584, 257, 267, 433, 432

[56] References Cited

U.S. PATENT DOCUMENTS

| | | | |
|---|---|---|---|
| 1,048,760 | 12/1912 | Taff | 123/73 CB |
| 1,115,481 | 11/1914 | Bachle et al. | 123/73 CC |
| 1,361,680 | 12/1920 | Carbonne et al. | 123/73 CB |
| 2,032,986 | 3/1936 | Howell et al. | 123/267 X |
| 3,363,611 | 1/1968 | Von Seggehn et al. | 123/433 |

FOREIGN PATENT DOCUMENTS

| | | | |
|---|---|---|---|
| 787696 | 12/1980 | U.S.S.R. | 123/59 BS |

*Primary Examiner*—Wendell E. Burns

[57] ABSTRACT

A crankchamber precompression type two-cycle internal combustion engine including cylinder assemblies of an even number consists of at least one pair of cylinder assemblies having working cycles with 180° phase difference, each cylinder assembly having a stepped cylinder constituted by a minor diameter cylinder portion and a major diameter cylinder portion, a stepped piston received in the stepped cylinder and constituted by a minor diameter piston portion and a major diameter piston portion, the minor diameter and major diameter piston portions being in sliding engagement with the minor diameter and the major diameter cylinder portions of the stepped cylinder respectively to provide an annular space serving as sub-intake chamber in the major diameter portions of the cylinders, the sub-intake chambers being connected to an auxiliary scavenging nozzle oriented toward a combustion chamber of the other associated cylinder. The sub-intake chambers are connected to auxiliary carburetors set beforehand in such a manner that they form a mixture of fuel of high quality and air, and crankchambers of the cylinders are connected to main carburetors set beforehand in such a manner that they form a mixture of fuel of low quality and air. By this arrangement, the mixture of fuel of high quality and air is first ignited in the combustion chambers to produce flame surfaces in a large area to enable complete combustion of the mixture of fuel of low quality with air to be achieved.

1 Claim, 5 Drawing Figures

CRANKCHAMBER PRECOMPRESSION TYPE TWO-CYCLE INTERNAL COMBUSTION ENGINE

BACKGROUND OF THE INVENTION

This invention relates to a crankchamber precompression type two-cycle internal combustion engine.

Generally two-cycle internal combustion engines suffer the disadvantage that they have a higher fuel consumption ratio than four-cycle internal combustion engines and consequently their fuel cost is high, because of a blow-bye phenomenon that occurs during the scavenging stroke in an engine of the crankchamber precompression type and because of a back-blow phenomenon that occurs in the low speed range when the engine is of the piston control type intake system.

SUMMARY OF THE INVENTION

This invention has been developed for the purpose of obviating the aforesaid disadvantage of the prior art. Accordingly the invention has as its object the provision of a crankchamber precompression type two-cycle internal combustion engine of an improved construction capable of reducing fuel cost effectively.

The aforesaid object of the invention is accomplished by providing, in a crankchamber precompression type two-cycle internal combustion engine, developed by us for purposes of effecting exhaust emission control and improving the delivery ratio and scavenging efficiency and disclosed in Japanese Patent Publication No. Sho-51-44249, cylinder assemblies of an even number consisting of at least one pair of cylinder assemblies having working cycles with 180° phase difference, each cylinder assembly comprising a stepped cylinder constituted by a minor diameter cylinder portion and a major diameter cylinder portion, a stepped piston received in the stepped cylinder and constituted by a minor diameter piston portion and a major diameter piston portion, the minor diameter and major diameter piston portions being in sliding engagement with the minor diameter and major diameter cylinder portions respectively, a sub-intake chamber defined between the major diameter cylinder portion and the minor piston portion, provided in the major diameter portions of the cylinders, the sub-intake chambers being connected to an auxiliary carburetor and an auxiliary scavenging nozzle oriented toward a combustion chamber of the other associated cylinder, and a crankchamber formed beneath the cylinder and connected to main carburetors, the feature that the auxiliary carburetors and the main carburetors are set beforehand in such a manner that the former form a mixture of fuel of high quality and air and the latter form a mixture of fuel of low quality and air.

By virtue of the aforesaid features, the crankchambers are used for effecting primary compression of the mixture of fuel of low quality and air and the sub-intake chambers in the major diameter cylinder portions are used for effecting primary compression of the mixture of fuel of high quality and air, while the mixture of fuel of high quality and air is supplied to a combustion chamber or a auxiliary combustion chamber of the other cylinder having an ignition plug, whereby the mixture of fuel of high quality and air in the combustion chamber or auxiliary combustion chamber is first ignited to burn to achieve complete combustion of the mixture of fuel of low quality and air in the combustion chamber by flame surfaces produced in a large area in the combustion chamber or the auxiliary combustion chamber by the aforesaid combustion of the mixture of fuel of low quality and air.

DETAILED DESCRIPTION OF THE PREFERRED EMBODIMENTS

Preferred embodiments of the invention will now be described by referring to the accompanying drawings.

Figure 1:
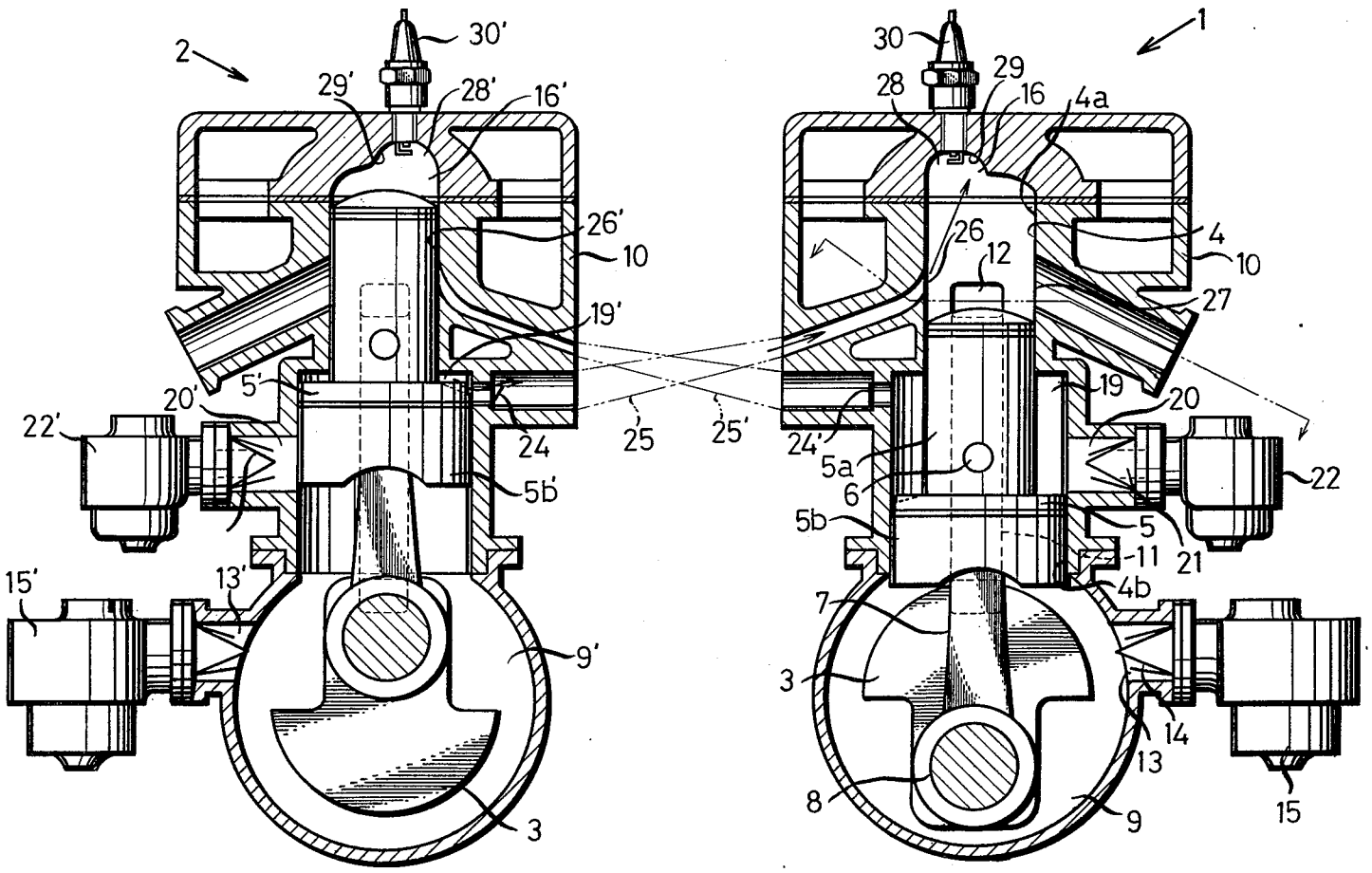
FIG. 1 is a sectional view of the first cylinder and the second cylinder of the two-cycle, two-cylinder internal combustion engine comprising one embodiment of the invention, the two cylinders being arranged on the right and left and shown in a cross section at a central plane of each cylinder perpendicular to the crankshaft.

FIG. 1 is a sectional view of the first and second cylinders of the two-cycle, two-cylinder internal combustion engine comprising one embodiment of the invention, the two cylinders being arranged on the right and left and shown in a section at a central portion of each cylinder perpendicular to the crankshaft. The first cylinder assembly 1 comprises a cylinder 4 formed with a minor diameter cylinder portion **4*a* and a major diameter cylinder portion 4*b* arranged coaxially and vertically. The first cylinder assembly 1 also comprises a working piston 5 formed with a minor diameter piston portion 5*a* and a major diameter piston portion 5*b* snugly received in the minor diameter cylinder portion 4*a* and the major diameter cylinder portion 4*b* respectively, so that the minor diameter portions 4*a* and 5*a* and the major diameter portions 4*b* and 5*b* of the cylinder 4 and piston 5 are in sliding engagement with each other to define an annular sub-intake chamber 19 between the major diameter cylinder portion 4*b* and the minor diameter piston portion 5*a* in the major diameter cylinder portion 4*b*. A crankshaft 3 is connected with the piston 5 through a connecting rod 7 which is connected to the piston 5 and the crankshaft 3 by means of a piston pin 6 and a crank-pin 8 respectively. The numeral 9 designates a crankchamber maintained in communication with a main scavenging port 12 in the minor diameter cylinder portion 4*a* through a main scavenging passageway 11 formed in a cylinder block 10. The crankchamber 9 is also maintained in communication with a main carburetor 15 through a suction passageway 13 and a check valve 14, the main carburetor 15 being set beforehand in such a manner that it forms a mixture of fuel of low quality, such as kerosene, light oil, etc. (alcohol may be included in a fuel of low quality), and air. Thus in an upward stroke of the piston 5 an upward movement of the major diameter piston portion 5*b* causes the pressure in the crankchamber 9 to drop and opens the check valve 14 to allow the mixture of fuel of low quality and air to be drawn by suction into the crankchamber 9 from the main carburetor 15, through the check valve 14 and suction passageway 13**. In a crankchamber compression stroke in which the piston 5 moves downwardly, a rise in pressure in the crankchamber 9 closes the check valve 14 and a new fuel-air mixture having its pressure raised in the crank chamber 9 is supplied to a main combustion chamber 16 through a main scavenging passageway 11 and a main scavenging port 12.

The annular sub-intake chamber 19 is in communication with an auxiliary carburetor 22 through an intake passageway 20 opening in the major diameter cylinder portion 4*b* and a check valve 21. The auxiliary carburetor 22 is set beforehand in such a manner that it forms a mixture of fuel of high quality, such as gasoline, alcohol, etc., and air. The sub-intake chamber 19, as subsequently to be described in relation to the second cylinder assembly, is in communication with an auxiliary scavenging nozzle 26' opening in the main combustion chamber 16' of the second cylinder assembly 2, through an auxiliary scavenging passageway 25' extending from upper portion of the sub-intake chamber and having a check valve 24' mounted therein. The second cylinder assembly 2 which has 180° phase difference with respect to the first cylinder assembly is of the same construction as the first cylinder assembly 1 and parts thereof corresponding to those of the first cylinder assembly 1 are designated by like reference characters provided with a dash (').

Figure 2:
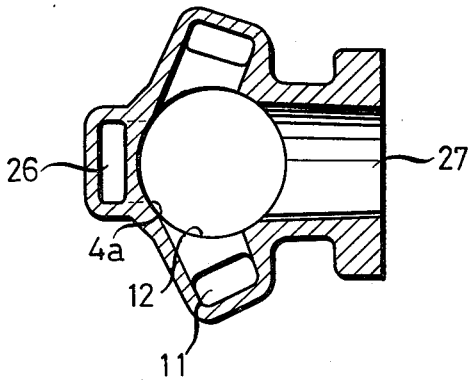
FIG. 2 is a horizontal sectional view of the first cylinder taken along the line II—II in FIG. 1.

The second cylinder assembly 2 has a sub-intake chamber 19' which is in communication with an auxiliary scavenging nozzle 26 opening in the main combustion chamber 16 of the first cylinder assembly 1 through an auxiliary scavenging passageway 25 having a check valve 24 mounted therein. In the embodiment shown and described herein, the auxiliary scavenging nozzle 26 opens obliquely upwardly, in a position at the minor diameter cylinder portion 4*a* which is slightly lower than an upper edge of an exhaust port 27 located on the opposite side of the minor diameter cylinder portion 4*a* and has a center line oriented toward a portion 29 of an inner wall surface of an auxiliary combustion chamber 28 located above the main combustion chamber 16 which is near the center of the minor diameter cylinder portion 4*a* as shown in FIGS. 1 and 2. As shown, the auxiliary combustion chamber 28 which is shaped like a bowl of relatively large depth and having a smooth inner wall surface has an ignition plug 30 mounted in the portion 29 of the inner wall surface. Thus in a downward stroke of a piston 5' of the second cylinder 2, a mixture of fuel of high quality and air introduced into a sub-intake chamber 19' from an auxiliary carburetor 22' through a check valve 21' and a suction passageway 20' is compressed when the piston 5' moves upwardly in a next following upward stroke thereof. The piston 5 which simultaneously moves downwardly as the piston 5' moves upwardly causes exhaust gases in the main combustion chamber 16 to be exhausted through the exhaust port 27 to cause the pressure in the main combustion chamber 16 to drop, so that a pressure differential is produced between the nozzle 26 and the sub-intake chamber 19'. This opens the check valve 24 to allow the mixture of fuel of high quality and air to be supplied to the auxiliary combustion chamber 28 as indicated by arrows.

Operation of the engine of the aforesaid construction will be described in general.

(1) Suction stroke: as indicated at the second cylinder assembly 2 shown in FIG. 1, a mixture of fuel of low quality and air is drawn by suction, in an upward stroke of the piston 5', into a crankchamber 9' from a main carburetor 15' through a suction passage 13' which is opened by the upward movement of the major diameter piston portion 5*b*', and at the same time a downward movement of the piston 5 of the first cylinder assembly 1 differing 180° in phase from the second cylinder assembly 2 allows a mixture of fuel of high quality and air to be drawn into the sub-intake chamber 19 by suction from the auxiliary carburetor 22.

(2) Scavenging stroke: as indicated at the first cylinder assembly 1 shown in FIG. 1, a mixture of fuel of low quality and air precompressed in the crankchamber 9 flows into the minor diameter cylinder portion 4*a* through the main scavenging port 12 that is opened immediately before the piston 5 reaches the bottom dead center. At the same time, a mixture of fuel of high quality and air that has been drawn by suction into the sub-intake chamber 19' of the second cylinder assembly 2 is precompressed by the upwardly moving piston 5' and ejected therefrom through the check valve 24 and the auxiliary scavenging nozzle 26 into the auxiliary combustion chamber 28 of the first cylinder assembly 1.

(3) Compression and explosion stroke: the compression stroke commences, as in an ordinary two-cycle engine, after the exhaust port 27 is blocked by the piston 5. By adjusting the main carburetors 15 and 15' and auxiliary carburetors 22 and 22' beforehand in such a manner that mixtures of fuel of high quality and air in the auxiliary combustion chambers 28 and 28' have an optimum air-fuel ratio suiting ignition immediately before the top dead center is reached, ignition is facilitated and flames are formed in a wide area and spread successively from the auxiliary combustion chambers 28 and 28' to the main combustion chambers 16 and 16', to enable the mixture of fuel of low quality and air to burn with a high degree of combustion efficiency.

(4) Exhaust stroke: this cycle takes place in the same manner as an ordinary three-port type two-cycle engine.

From the foregoing description, it will be appreciated that the present invention is incorporated in a two-cycle, two-cylinder engine as described hereinabove and enables a two-cycle, two-cylinder engine to be driven with fuel of high quality of small volume and fuel of low quality of large volume with a higher degree of efficiency than an ordinary three-port or two-port type two-cylinder engine, thereby enabling fuel cost to be reduced by using fuel of low quality. The provison of a scavenging pumping function in upper and lower portions of the major diameter piston portion 5*b* enables the delivery ratio and scavenging efficiency to be improved.

The invention can achieve the same effects as described hereinabove by being incorporated in each pair of cylinders interconnected with 180° phase difference of a multiple cylinder engine having cylinders of an even number. In this case, the cylinders forming a pair are preferably located in adjacent relationship to minimize the length of the auxiliary scavenging passageway 25. Also, when the invention is incorporated in a concrete form, the auxiliary scavenging nozzle 26 may be made to directly open in the auxiliary combustion chamber 28. The check valve 24 is shown as being a reed valve, but the invention is not limited to this specific form of check valve and any known suitable valve, such as a ball valve of the type forcing a ball into engagement with a valve seat by the biasing force of a compression spring, a poppet valve and a rotary valve for avoiding a back flow adapted to be actuated by a cam mechanism, etc.

Figure 3:
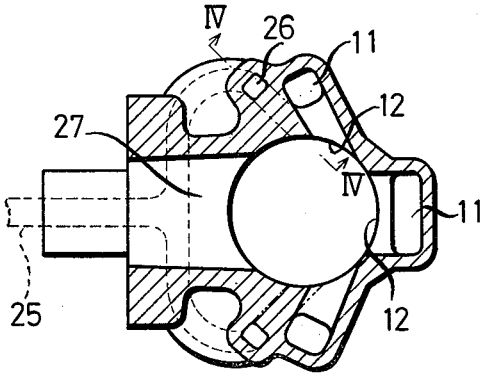
FIG. 3 is a horizontal sectional view corresponding to FIG. 2 of another embodiment.
Figure 4:
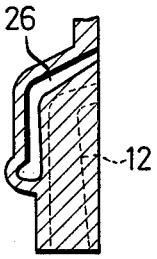
FIG. 4 is a fragmentary sectional view taken along the line IV—IV in FIG. 3.
Figure 5:
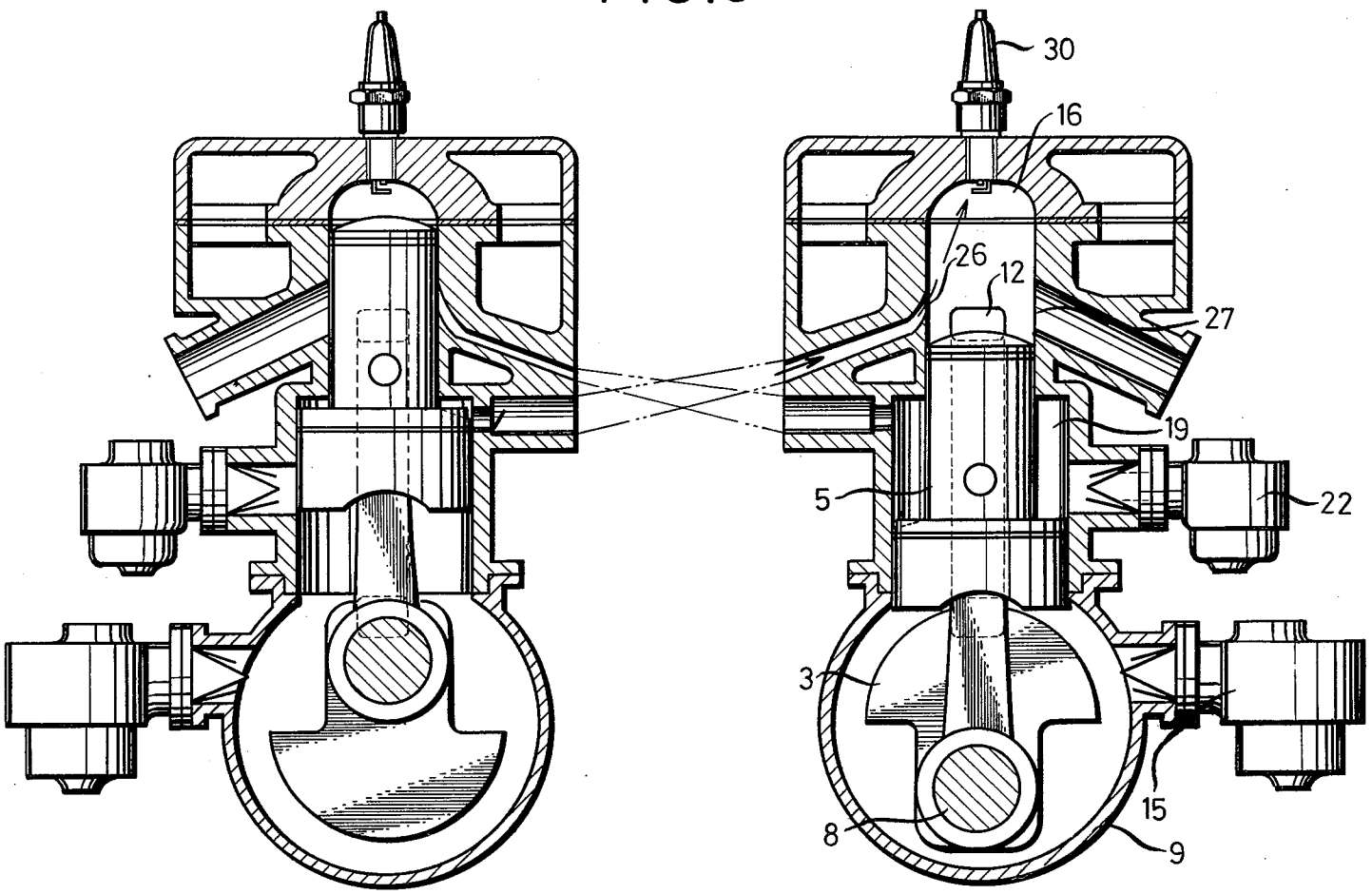
FIG. 5 is a sectional view corresponding to FIG. 1 but showing the cylinders of the two-cycle, two-cylinder internal combustion engine comprising still another embodiment.

The relative positions of the opening of the auxiliary scavenging nozzle 26 and the main scavenging port 12 may be as shown in FIGS. 3 and 4. In this case, it is possible to more positively lead the mixture of fuel of high quality and air to the auxiliary combustion chamber 28 from the auxiliary scavenging nozzle 26 and blow-bye can be reduced. FIG. 5 shows a still another embodiment in which the auxiliary scavenging nozzle 26 opens in the vicinity of the spark gap of the ignition plug 30 in the main combustion chamber 16 which has no auxiliary combustion chamber.

What is claimed is:

1. A crankchamber precompression type two-cycle internal combustion engine comprising:

cylinder assemblies of an even number consisting of at least one pair of cylinder assemblies having working cycles with 180 phase difference, each cylinder assembly comprising:

a stepped cylinder constituted by a minor diameter cylinder portion and a major diameter cylinder portion;

a stepped piston received in said stepped cylinder and constituted by a minor diameter piston portion and a major diameter piston portion, said minor diameter and major diameter piston portions being in sliding engagement with the minor diameter and the major diameter cylinder portions of said stepped cylinder respectively;

a sub-intake chamber defined between the major diameter portion of said cylinder and the minor diameter portion of said piston, said sub-intake chamber being connected to an auxiliary carburetor and an auxiliary scavenging nozzle oriented toward a combustion chamber of the other associated cylinder assembly; and a crankchamber connected to said major diameter portion of said cylinder, and connected to a main carburetor and a scavenging passageway oriented toward a combustion chamber of said cylinder assembly;

wherein the improvement resides in that the auxiliary carburetors and the main carburetors are set beforehand in such a manner that the former form a mixture of fuel of high quality and air and the latter from a mixture of fuel of low quality and air, and said sub-intake chamber is in communication with said scavenging nozzle of the associated cylinder through a passage having only a check valve mounted therein.

* * * * *